US009878294B2

(12) United States Patent
Liu et al.

(10) Patent No.: US 9,878,294 B2
(45) Date of Patent: Jan. 30, 2018

(54) APPARATUS, SYSTEM, AND METHODS FOR BLENDING CRUDE OILS

(71) Applicant: ProSep, Inc., Houston, TX (US)

(72) Inventors: Yi Liu, Houston, TX (US); Carl Nilsson, Stavanger (NO); Vincent P. Buchanan, Houston, TX (US)

(73) Assignee: PROSEP, INC, Houston, TX (US)

( * ) Notice: Subject to any disclaimer, the term of this patent is extended or adjusted under 35 U.S.C. 154(b) by 603 days.

(21) Appl. No.: 14/304,415

(22) Filed: Jun. 13, 2014

(65) Prior Publication Data

US 2015/0048004 A1 Feb. 19, 2015

Related U.S. Application Data

(60) Provisional application No. 61/834,801, filed on Jun. 13, 2013.

(51) Int. Cl.

| | |
|---|---|
| ***B01F 5/06*** | (2006.01) |
| ***B01F 3/10*** | (2006.01) |
| ***B01F 5/04*** | (2006.01) |
| ***B01F 3/08*** | (2006.01) |

(52) U.S. Cl.

CPC ..... *B01F 5/0688* (2013.01); *B01F 3/0861* (2013.01); *B01F 3/0865* (2013.01); *B01F 3/10* (2013.01); *B01F 5/0463* (2013.01); *B01F 2003/0884* (2013.01); *B01F 2003/105* (2013.01); *B01F 2215/0067* (2013.01); *B01F 2215/0431* (2013.01)

(58) Field of Classification Search

CPC .... B01F 5/0688; B01F 3/0861; B01F 3/0865; B01F 3/10; B01F 5/0463; B01F 2003/0884; B01F 2215/0067; B01F 2215/0431; B01F 2003/105

See application file for complete search history.

(56) References Cited

U.S. PATENT DOCUMENTS

| | | | | |
|---|---|---|---|---|
| 5,597,236 | A | 1/1997 | Fasano | 366/181.5 |
| 6,132,079 | A | 10/2000 | King | 366/181.5 |
| 2009/0174087 | A1 | 7/2009 | Bauer | 261/66 |

FOREIGN PATENT DOCUMENTS

| | | |
|---|---|---|
| WO | WO 2001/007169 | 2/2001 |

OTHER PUBLICATIONS

International Search Report and Written Opinion for PCT/US2014/042365 dated Oct. 10, 2014.

International Preliminary Report on Patentability for PCT/US2014/042365 dated Sep. 29, 2015.

*Primary Examiner* — Renee Robinson

*Assistant Examiner* — Derek Mueller

(74) *Attorney, Agent, or Firm* — Norton Rose Fulbright US LLP

(57) ABSTRACT

This application includes mixing devices, methods, and systems in which a second fluid can be introduced through a second flow channel to a dispersion member for extrusion through a perforated portion of a dispersion member into a first flow channel for mixing with a first fluid. In some of the present mixing devices, methods, and systems, the second flow channel is substantially perpendicular to the first flow channel, and/or the perforated portion is disposed on a downstream portion of the dispersion member.

23 Claims, 6 Drawing Sheets

APPARATUS, SYSTEM, AND METHODS FOR BLENDING CRUDE OILS

PRIORITY CLAIM

This application claims priority to U.S. Provisional Patent Application No. 61/834,801 filed Jun. 13, 2013 which is incorporated here by reference in its entirety.

FIELD OF INVENTION

The present invention relates to a mixer for blending crude oils and, more particularly, but not by way of limitation. to an extrusion mixer for blending heavy viscous crude oil with a lighter crude oil.

BACKGROUND

Blending of different types of crude oils is a common process in the oil industry. Such blending is done to achieve a number of goals, for example: (1) to reduce the size and number of downstream process equipment by improving the viscosity and/or density components of crude oil that must be processed; (2) to improve the pipeline transport capacity of a heavy and/or viscous crude by mixing with a lighter, less viscous crude oil so that the mixture has acceptable viscosity for pipeline transport; (3) to achieve certain pipeline quality specifications, for example a crude oil that exceeds the pipeline specification on elemental sulfur, total acid number (TAN) acid content can be mixed with crude that is low in these components so that the mixture is kept below the pipeline requirements; and/or (4) to achieve certain refinery quality specifications, a low quality crude oil that is not acceptable can be mixed with a high quality one such that the mixture fulfills such requirements and can be processed in the refinery.

Current systems for crude oil blending use either inline static mixers or dynamic mixers for crude oil mixing. In general, the primary difference between static mixers and dynamic mixers is that dynamic mixers require an external power source to drive the mixing.

Static mixers, such as the one depicted in FIG. 1, typically include one or more mixing elements placed in the pipe downstream of the point at which the crude oils are merged together into a single piping stream. Such mixers generally operate on the basis of hydrodynamics where the mixing action is caused by energy created from pressure lost. For low viscosity fluids, such mixers may be acceptable as the pressure loss over the mixer will be low or moderate, but where one or both of the oils have high viscosity, the pressure loss over the mixer can be unacceptably large.

SUMMARY

The present mixers or mixing devices, systems, and methods can be configured to mix heavy crude oils with lighter oils with a lower pressure drop or loss through the mixer than has typically been possible with prior art static mixers, and/or without requiring recirculation of mixed oils via pumping and re-injecting them upstream of the mixer.

The present embodiments can be configured to blend a heavy and/or more viscous crude oil with a light and/or less-viscous crude oil. The present embodiments use an unconventional static mixer design, having a pressure drop that is typically lower than prior art static mixers, and permit a heavy, more-viscous crude oil to be introduced (e.g., extruded) into a light, less-viscous crude oil by via a perforated portion of a dispersion member for a first mixing step. In this step, for example, the heavy crude oil can be extruded as small cylindrical "strips" into the light oil, distributed over a large portion of the pipe cross-sectional area to facilitate dissolution of the heavy crude oil into the light crude oil.

In some embodiments, a second optional mixer may be placed downstream of the first mixer to further ensure that the two crude oil fluids are homogenously mixed.

In some embodiments, a measuring station can be placed downstream of the mixing stage(s), such as, for example, downstream of an optional second mixer. The measuring station can be configured and/or used to measure physical parameters of the mixture (e.g., density and/or viscosity) to ensure the quality of the mixture and/or, if necessary, adjust the inlet flows of the crudes to the mixer to achieve a mixture with desired properties. In case of multiphase flows (e.g., gas and/or water in oil) the measuring station can be configured and/or used to isolate the non-oil components such that the physical parameters of oil mixture can be measured. In some such embodiments, the measuring station is disposed in close proximity to the mixer(s) (e.g., within 20, 15, 10, and/or fewer feet), such as, for example, to reduce response time when adjustments are desired.

In some of the present embodiments, a basket-like insert having a perforated portion is provided in a piping T-junction or T-element. The perforated portion of the insert can include a number of holes of sufficient diameters to define an open area or total flow area large enough so that the differential pressure from the inside to the outside of the pocket is negligible (e.g., less than twenty, ten, or fewer percent of the inlet pressure).

Some embodiments of the present mixing devices (e.g., for mixing a first oil fluid with a second oil fluid of a different viscosity and/or density) comprise: a body defining a first inlet, a first outlet, and a first flow channel extending from the first inlet to the first outlet, the body further defining a second inlet having a longitudinal axis that is disposed at a non-parallel angle relative to a longitudinal axis of the first flow channel; and a dispersion member configured to be coupled to the body such that a sidewall of the dispersion member extends into the first flow channel with an upstream portion of the sidewall facing the first inlet and a downstream portion of the sidewall facing the first outlet, the dispersion member defining a second flow channel in fluid communication with the second inlet; where the downstream portion of the sidewall extending into the first flow channel includes a perforated portion.

In some embodiments of the present mixing devices, the dispersion member is configured to extrude a second oil fluid from the second inlet through the perforated portion into the first flow channel to mix with a first oil fluid having a lower viscosity and/or lower density flowing in the first flow channel from the first inlet. In some embodiments, the perforated portion includes a plurality of perforations. In some embodiments, the plurality of perforations each includes a circular opening through the sidewall. In some embodiments, the plurality of perforations each has a maximum transverse dimension and is spaced from at least one other one of the plurality of perforations by a distance that is smaller than the maximum transverse dimension. In some embodiments, the plurality of perforations includes more than ten perforations. In some embodiments, the plurality of perforations includes more than thirty perforations. In some embodiments, the plurality of perforations have an open area that is greater than thirty percent (e.g., greater than fifty percent) of an area of the perforated portion. In some embodiments, the area of the perforated portion does not differ from the cross-sectional area of the first flow channel by more than thirty percent of the cross-sectional area of the first flow channel. In some embodiments, the plurality of perforations have an open area that does not differ from the cross-sectional area of the first flow channel by more than fifty percent (e.g., by more than thirty percent) of the cross-sectional area of the first flow channel.

In some embodiments of the present mixing devices, the non-parallel angle is between 70 degrees and 110 degrees. In some embodiments, the non-parallel angle is between 80 degrees and 100 degrees. In some embodiments, the upstream portion of the sidewall extending into the first flow channel is not perforated. In some embodiments, the second flow channel has a cross-sectional shape that is curved. In some embodiments, the second flow channel has a cross-sectional shape that is circular. In some embodiments, the dispersion member has an outer cross-sectional shape that is curved. In some embodiments, the dispersion member has an outer cross-sectional shape that is circular. In some embodiments, the body further comprises a second outlet in fluid communication with the first flow channel.

Some embodiments of the present mixing devices (e.g., for mixing a first oil fluid with a second oil fluid of a different viscosity and/or density) comprise: a body defining a first inlet, a first outlet, and a first flow channel from the first inlet to the first outlet, the body further defining a second inlet; and a dispersion member configured to be coupled to the body such that a sidewall of the dispersion member extends into the first flow channel with an upstream portion of the sidewall facing the first inlet and a downstream portion of the sidewall facing the first outlet, the dispersion member defining a second flow channel in fluid communication with the second inlet; where the downstream portion of the sidewall extending into the first flow channel includes a perforated portion with a plurality of perforations having an open area that does not differ from the cross-sectional area of the first flow channel by more than thirty percent of the cross-sectional area of the first flow channel.

Some embodiments of the present systems comprise: an embodiment of the present mixing devices; and a second mixing device coupled to the first outlet of the first mixing device; where the second mixing device is different than the first mixing device.

Some embodiments of the present methods (e.g., for mixing two fluids having different viscosities) comprise: introducing a second fluid into a second flow channel defined by a sidewall of a dispersion member having an upstream imperforate portion and a downstream perforated portion, such that the second fluid is extruded through the perforated portion; where the dispersion member extends into a first flow channel having a first fluid flowing through the primary channel, a longitudinal axis of the second flow channel is disposed at a non-parallel angle relative to a longitudinal axis of the first flow channel, and the viscosity and/or density of the second fluid is greater than the viscosity and/or density of the first fluid.

Some embodiments of the present methods (e.g., for mixing two fluids having different viscosities) comprise: introducing a second fluid into the second flow channel of an embodiment of the present mixing devices; where the viscosity and/or density of the second fluid is greater than the viscosity and/or density of the first fluid.

In some embodiments of the present methods, the first fluid flows through the first flow channel at a first flowrate, the second fluid is introduced into the second flow channel at a second flowrate, and the second flowrate does not differ from the first flowrate by more than fifty percent of the first flowrate. In some embodiments, the second flowrate does not differ from the first flowrate by more than thirty percent of the first flowrate. In some embodiments, the first and second fluids each comprise crude oil.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, 10, and 20 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DESCRIPTION OF ILLUSTRATIVE EMBODIMENTS

Figure 1:
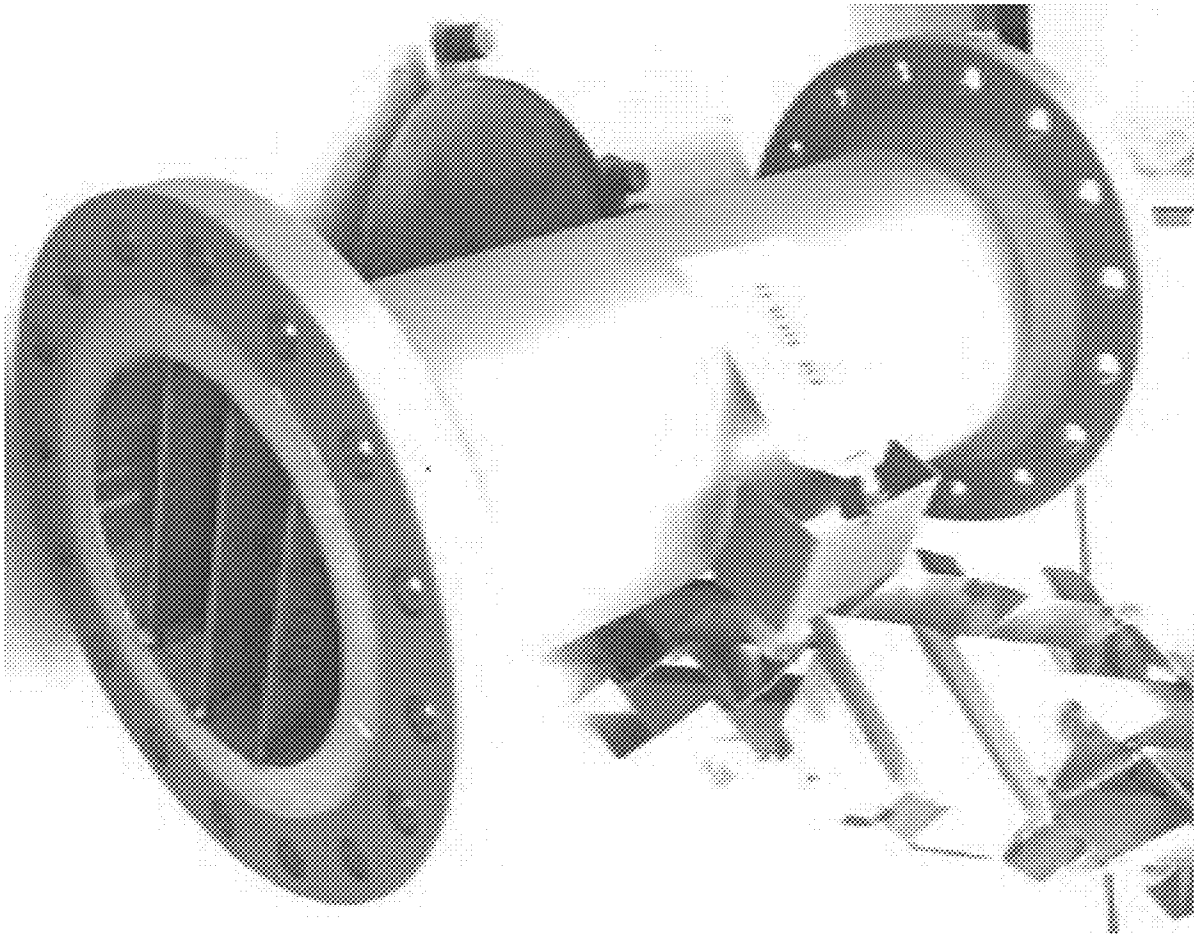
FIG. 1 (PRIOR ART)
FIG. 1 depicts a typical example of a prior art inline static type mixer.
Figure 2:
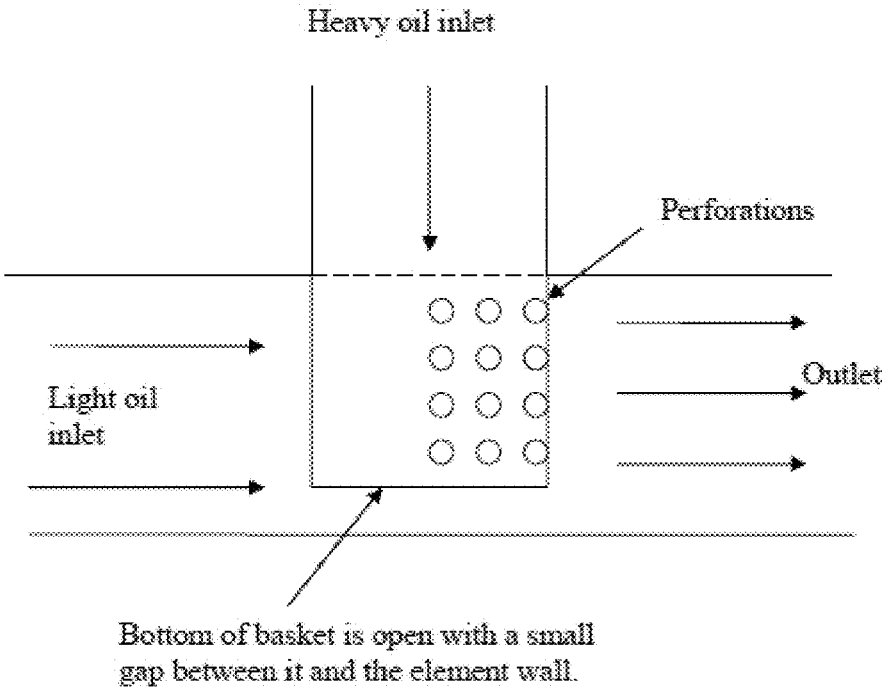
FIG. 2 depicts a conceptual diagram of a side view of a first embodiment of the present extrusion mixers.
Figure 3:
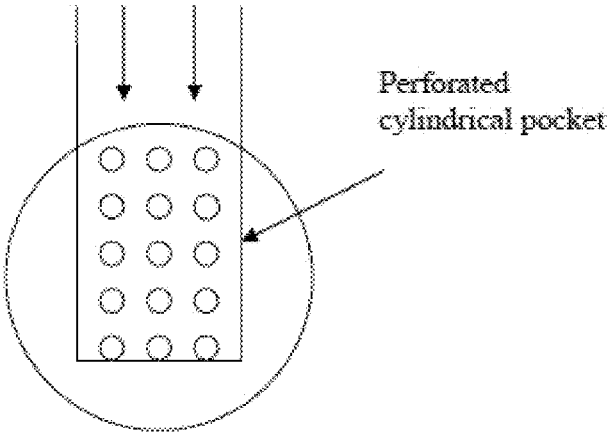
FIG. 3 depicts a conceptual diagram of an end view of the first embodiment facing an outlet port of the extrusion mixer.
Figure 4A:
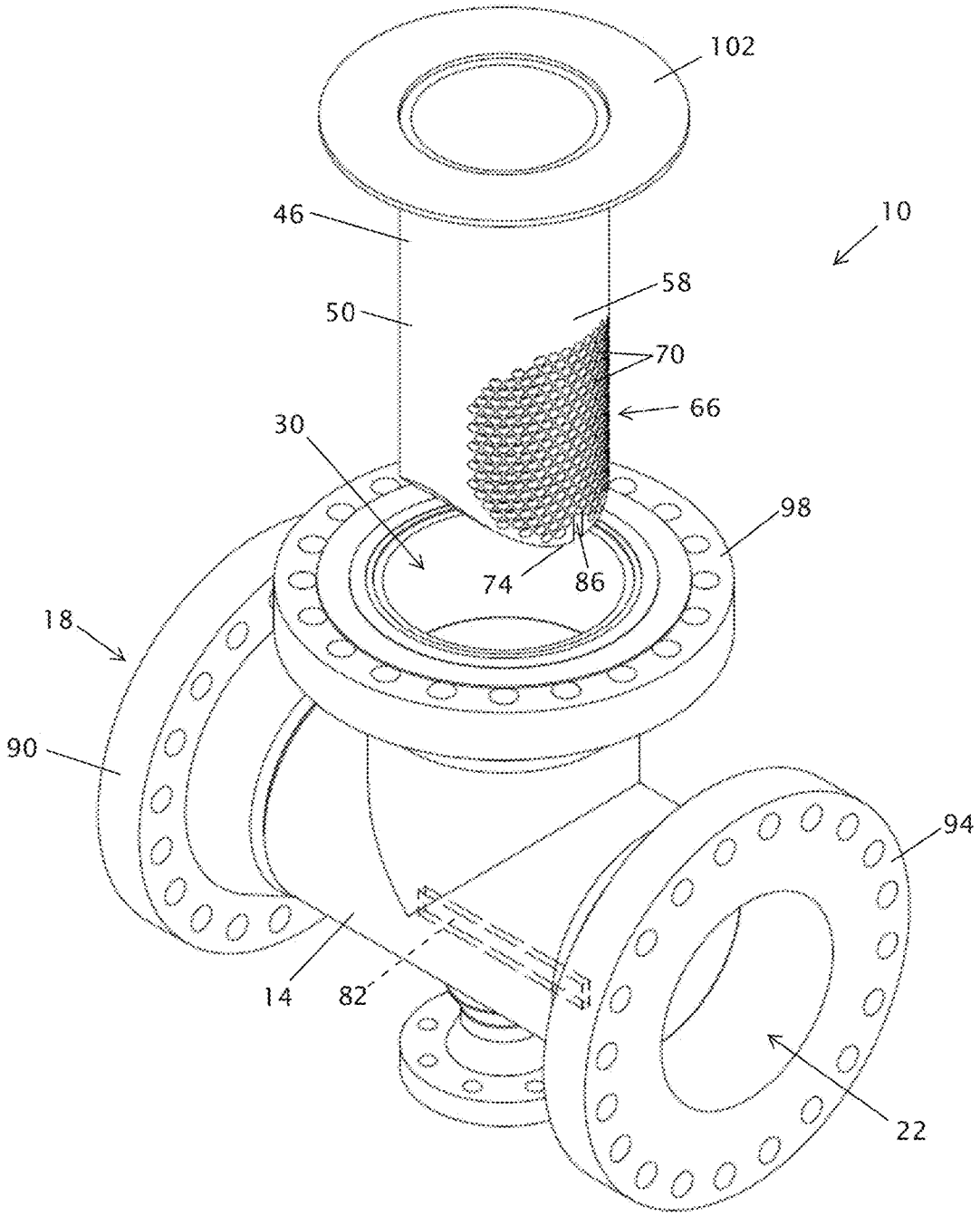
FIG. 4A depicts a perspective view of a second embodiment of the present extrusion mixers.
Figure 4C:
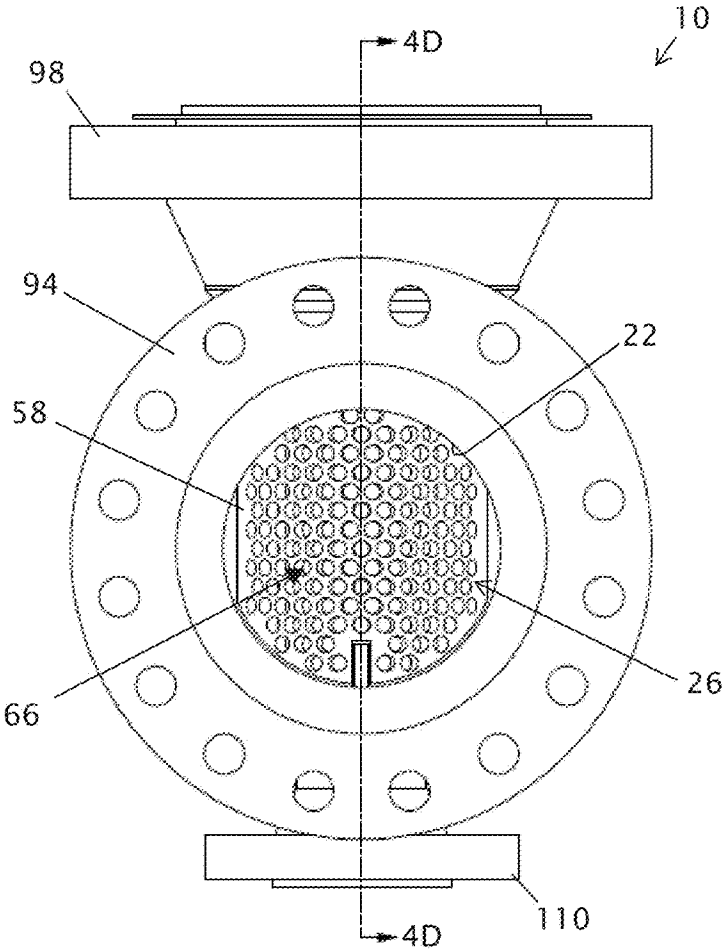
FIGS. 4B and 4C depict side views of first inlet and first outlet ends, respectively, of the second embodiment.
Figure 4B:
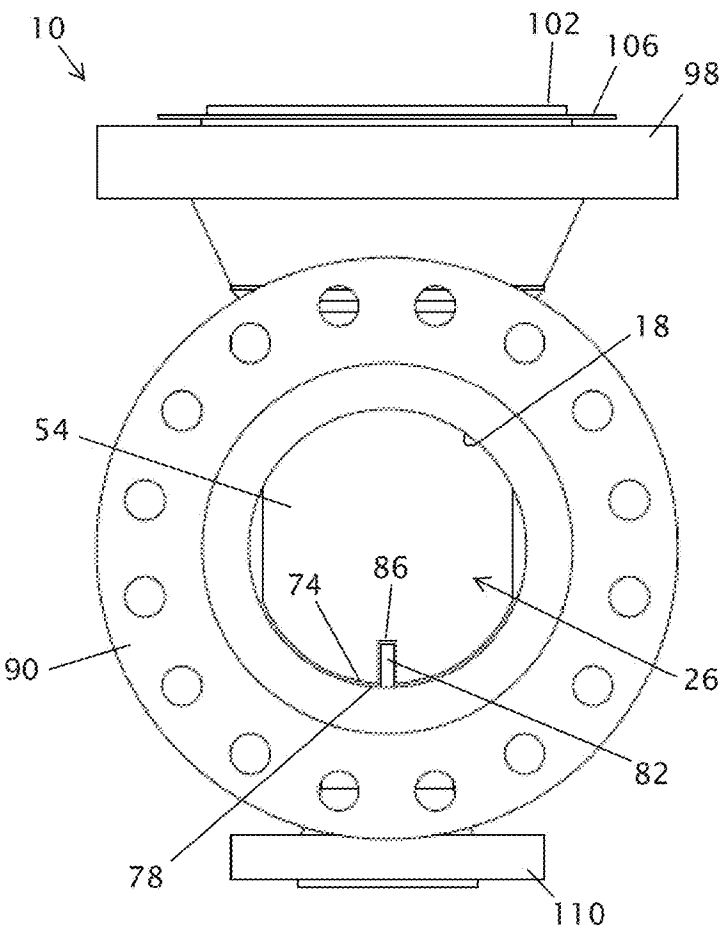
Figure 4D:
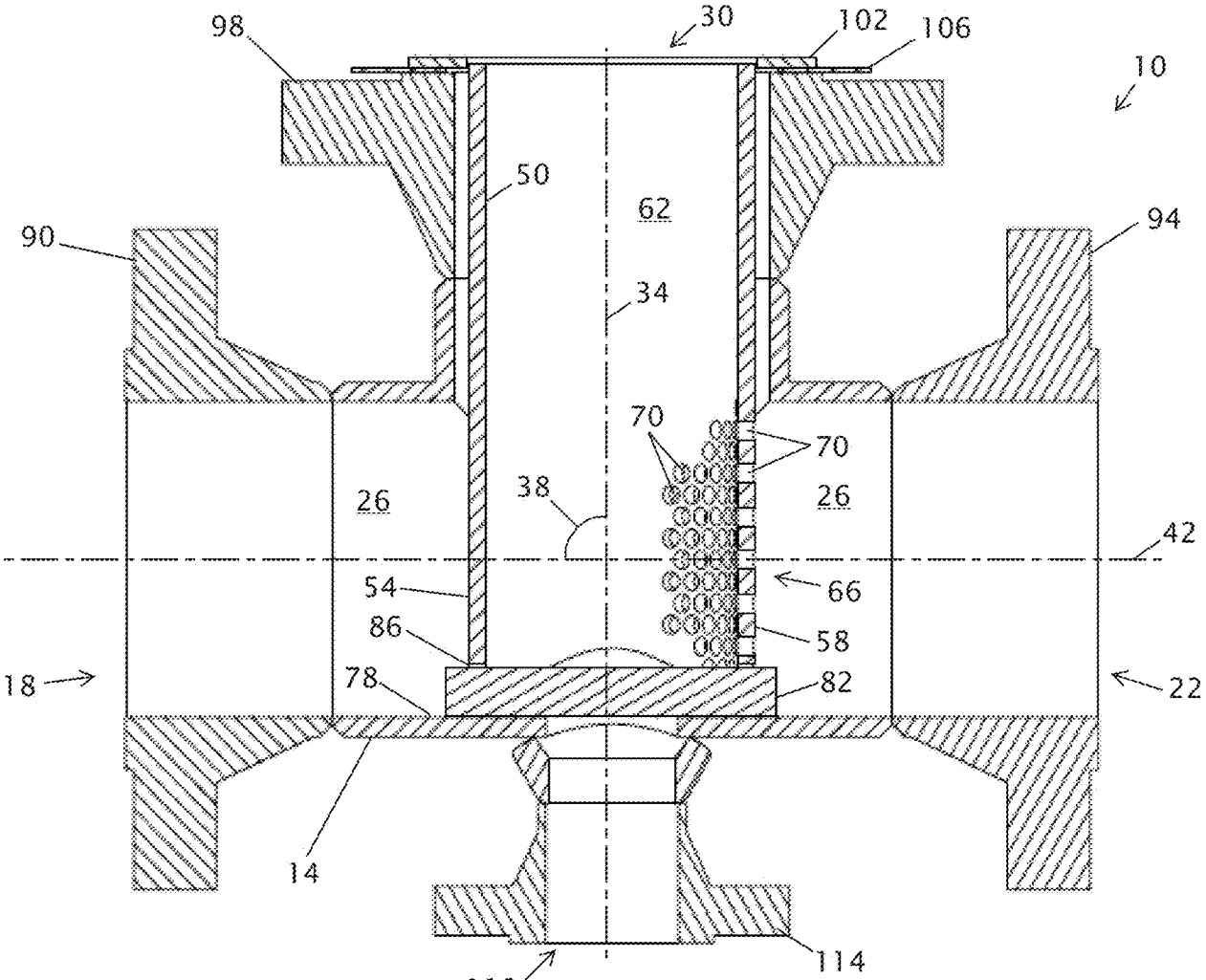
FIG. 4D depicts a side cross-sectional view of the second embodiment taken along the line 4D-4D of FIG. 4C.

FIGS. 2-3 depict conceptual diagrams of a first embodiment of the present extrusion mixers or mixing devices. In the embodiment shown, heavy crude oil can be introduced in the inlet arm of the branch connection of a T-element that is connected to an internal basket, while the light oil is introduced into a run arm of the T-element. The arrangement is such that the basket is fully immersed in the light oil and the perforations or holes in the basket are mainly oriented toward the common outlet end (opposite run arm) of the T-element.

The operation of the mixer can be described as follows. The mixer is designed to "extrude" the heavy oil into the light oil through a number of holes in the basket. This basket is immersed in the light oil stream, and thereby the heavy oil is well distributed into the light oil stream immediately, producing a large surface contact area between the extruded heavy oil and the light oils flowing through the run arm of the T-element. This helps the heavy oil to quickly dissolve into the light oil. The light oil is directed around the outside of the basket between the basket and the interior of the T-element wall toward the center of the outlet run arm, increasing the mixing action between the two oils.

FIG. 3 illustrates the outlet port of the extrusion mixer through which the heavy crude oil is extruded. The mixing ratio between the two crudes can simply be adjusted by control valves upstream the mixing element (not shown in the figures).

FIGS. 4A-4D depict various views of a second embodiment 10 of the present extrusion mixers or mixing devices. In the embodiment shown, mixer 10 comprises a body 14 that has the shape of a T-element. In this embodiment, body 14 defines a first inlet 18, a first outlet 22, and a first flow channel 26 extending from the first inlet to the first outlet. In the embodiment shown, body 14 further defines a second inlet 30 that is directly or indirectly in fluid communication with the first flow channel (e.g., via a dispersion member, such as is described below). In this embodiment, second inlet 30 has a (e.g., central) longitudinal axis 34 that is disposed at a non-parallel angle 38 relative to a (e.g., central) longitudinal axis 42 of the first flow channel. Angle 38 is shown substantially perpendicular but may, in other embodiments, be between 70 degrees and 110 degrees (e.g., between 80 degrees and 100 degrees and/or between 85 and 95 degrees). In this embodiment, axis 34 and axis 42 are substantially co-planar. In other embodiments, axis 34 and axis 42 need not be co-planar as long as axes 34, 42 are arranged to permit the functionality described in this disclosure.

In the embodiment shown, mixer 10 further comprises a dispersion member 46 configured to be coupled to body 14 such that a sidewall 50 of the dispersion member extends into first flow channel 26 with an upstream portion 54 of the sidewall facing or oriented toward first inlet 18 and a downstream portion 58 of the sidewall facing or oriented toward first outlet 22. In this embodiment, dispersion member defines a second flow channel 62 in fluid communication with second inlet 30. For example, as shown, second flow channel 62 extends through second inlet 30 and is also in indirect fluid communication with second inlet 30 via first flow channel 26. While dispersion member 46 defines second flow channel 62 to extend through second inlet 30 in the depicted embodiment; in other embodiments, second flow channel 62 need not extend all the way through the second inlet. In some embodiments, second flow channel 62 has a cross-sectional shape that is curved (e.g., circular, as shown). In the embodiment shown, dispersion member 46 may be described as basket-like as it resembles that shape of a basket having an open lower end. In other embodiments, the lower end of dispersion member 46 may be partially or entirely closed.

In the embodiment shown, downstream portion 58 of the sidewall that extends into first flow channel 26 includes a perforated portion 66. In this embodiment, dispersion member 46 is configured to extrude a second (e.g., higher-viscosity and/or higher-density) oil fluid from (i.e., entering body 14 through) second inlet 30 through perforated portion 66 into first flow channel 26 to mix with a first oil fluid having a lower viscosity and/or lower density flowing in the first flow channel from (i.e., entering body 14 through) first inlet 18. For example, in the embodiment shown, upstream portion 54 of sidewall 50 is imperforate (not perforated) and is substantially solid such that a first fluid flowing into the first flow channel via first inlet 18 must flow around dispersion member 46, increasing velocity of the first fluid and creating turbulence downstream of dispersion member 46 to assist with mixing with a second fluid that can be extruded through perforated portion 66 of extrusion member 46. In some embodiments, dispersion member 46 has (e.g., sidewall 50) defines an outer cross-sectional shape that is curved (e.g., circular, as shown), such as, for example, to reduce or minimize turbulence upstream of and in the vicinity of upstream portion 54 of dispersion member 46.

In the embodiment shown, perforated portion 66 includes a plurality of perforations 70 (e.g., each including a circular opening through sidewall 50, as shown). In general, the relationship between the open area of perforations 70 and the cross-sectional area of primary flow path 26 will affect pressure drop of fluid flowing through or across mixer 10 (between first inlet 18 and first outlet 22). For example, for substantially equal flow rates of first and second fluids into first inlet 18 and second inlet 22, the closer the ratio of the open area of perforations 70 to cross-sectional area of first flow channel, the smaller the pressure drop across the mixer will be. The open area of perforations 70 (the aggregate open area of all perforations) can be adjusted by varying the size and number of perforations 70, provided that structural integrity of dispersion member 46 and sidewall 50 should be maintained. For example, in the embodiment shown, each perforation 70 has a maximum transverse dimension (e.g., diameter for the circular perforations of this embodiment) and is spaced from at least one other one (e.g., multiple ones) of the other perforations 70 by a distance that is smaller than the maximum transverse dimension (diameter). Stated another, each perforation 70 is wider than the distance to the one or more of the nearest other perforations 70. In the embodiment shown, the plurality of perforations 70 includes more than ten perforations (e.g., more than thirty perforations).

In the embodiment shown, perforated portion 66 has an area that can be defined by the area enclosed by the smallest polygon that circumscribes all of perforations 70, such that the open area of perforations 70 can be described relative to the area of perforated portion 66. For example, in some embodiments, perforations 70 have an open area that is greater than thirty percent (e.g., greater than fifty percent, as shown) of the area of perforated portion 66. The area of perforated portion 66 and/or the open area of perforations 70 can also be defined with reference to the cross-sectional area of first flow channel 26. For example, in some embodiments, such as the one shown, the area of perforated portion 66 does not differ from the cross-sectional area of first flow channel 26 by more than thirty percent of the cross-sectional area of the first flow channel (e.g., the area of perforated portion 66 is not less than 70 square inches, and not more than 130 square inches, for a first flow channel with a cross-sectional area of 100 square inches). By way of further example, in some embodiments, such as the one shown, perforations 70 have an open area that does not differ from the cross-sectional area of first flow channel 26 by more than fifty percent of the cross-sectional area of the first flow channel (e.g., the open area of perforations 70 is not less than 50 square inches, and not more than 150 square inches, for a first flow channel with a cross-sectional area of 100 square inches). In some embodiments, perforations 70 have an open area that does not differ from the cross-sectional area of first flow channel 26 by more than thirty percent of the cross-sectional area of the first flow channel. With these and other variations of number, size, and/or shape of perforations 70, the open area provided by perforations 70 can be adjusted and, thus, the pressure drop across mixer 10 can also be adjusted (e.g., reduced, which is likely to be desirable in many applications).

In most embodiments, dispersion member 46 is configured to extend a majority of the distance across first flow channel 26 to, in use, distribute extruded fluid across a majority of at least one transverse dimension of (e.g., diameter, for the depicted circular cross-sectional shape shown for) first flow channel 26. For example, in the embodiment shown, a lower end 74 of dispersion member 46 extends to within 0.5±0.5 inch (e.g., 0.5±0.25 inch), of an interior surface 78 of body 14 that defines first flow channel 26. In this embodiment, lower end 74 is also contoured to match the contour of the nearest portions of surface 78 such that a gap, if provided as in the depicted embodiment, is substantially constant across the perimeter of the lower end of dispersion member 46, as shown.

In some embodiments, such as those with a gap between the lower end of dispersion member and surface 78, dispersion member 46 and/or body 14 are further configured to resist rotation of dispersion member 46 relative to body 14 (e.g., to maintain the orientation of dispersion member 46 such that perforated portion 66 is substantially centered around axis 42). For example, in the embodiment shown, a guide bar 82 extends upward from (e.g., is coupled via a weld to) surface 78, and lower end 74 of dispersion member 46 defines one or more notches 86 (e.g., two notches 86 on opposing sides of the dispersion member) configured to receive bar 82 when the dispersion member is coupled to body 14, as shown.

In various embodiments, mixer can be configured to be removably coupled to various other conduits and/or components of various systems (e.g., crude oil mixing and/or treatment systems). For example, in the embodiment shown, body 14 comprises a first inlet flange 90 through which first inlet 18 is defined, a first outlet flange 94 through which first outlet 22 is defined, and a second inlet flange 98 through which second inlet 30 is defined. Flanges 90, 94, and 98 can each be of known construction in which a plurality of bolt holes are provided around the circumference of flange to connect the flange to a similar flange of another component. In other embodiments, the flanges may take any form that permits connection of mixer 10 to conduits or other components, or the flanges may be omitted entirely body 14 may be directly welded to conduits and/or other components at one or all of first inlet 18, first outlet 22, and second inlet 30. In some embodiments, flange 98 is configured to cooperate with dispersion member 46 and an adjacent flange to secure dispersion member 46. For example, in the embodiment shown, dispersion member 46 comprises a flange 102 secured (e.g., via a weld) to an upper end of sidewall 50 and configured to be pinched or compressed between flange 98 and a flange of an additional component that is secured to flange 98. In some embodiments, a gasket 106 can be disposed between flange 102 of the dispersion member and flange 98 of the body, and/or between flange 102 and the flange of the additional component that is secured to flange 98.

In the embodiment shown, body 14 further comprises a second outlet 110 in communication with first flow channel 26. In this embodiment, second outlet 110 is disposed on a lower side of the first flow channel such that second outlet 110 can serve as a drain, such as, for example, for cleaning and/or maintenance of the mixer. In the embodiment shown, body 14 includes an additional flange 114 through which second outlet 110 is defined. Flange 114 is similar to flanges 90, 94, 98, with the exception that flange 114 will be smaller in most embodiments because second outlet 110 will typically be blocked during use. For example, a valve can be coupled to second outlet 110 (e.g., via flange 114 and/or an intervening conduit), and the valve can normally be kept closed to prevent flow through second outlet 110.

The dimensions of mixer 10 can be adjusted for various embodiments and applications. For example, in the depicted embodiment that is adapted for mixing crude oils, the first inlet 18, first outlet 22, and second inlet each has a nominal inner diameter of 12 inches (e.g., 12±0.5 inches), dispersion member 46 defines second flow channel 62 with a nominal inner diameter of 9 inches (e.g., 9±0.5 inches), and second outlet 110 has a nominal inner diameter of 4 inches (e.g., 4±0.5 inches). Other embodiments can have any suitable dimensions that permit the functionality described in this disclosure.

Figure 5:
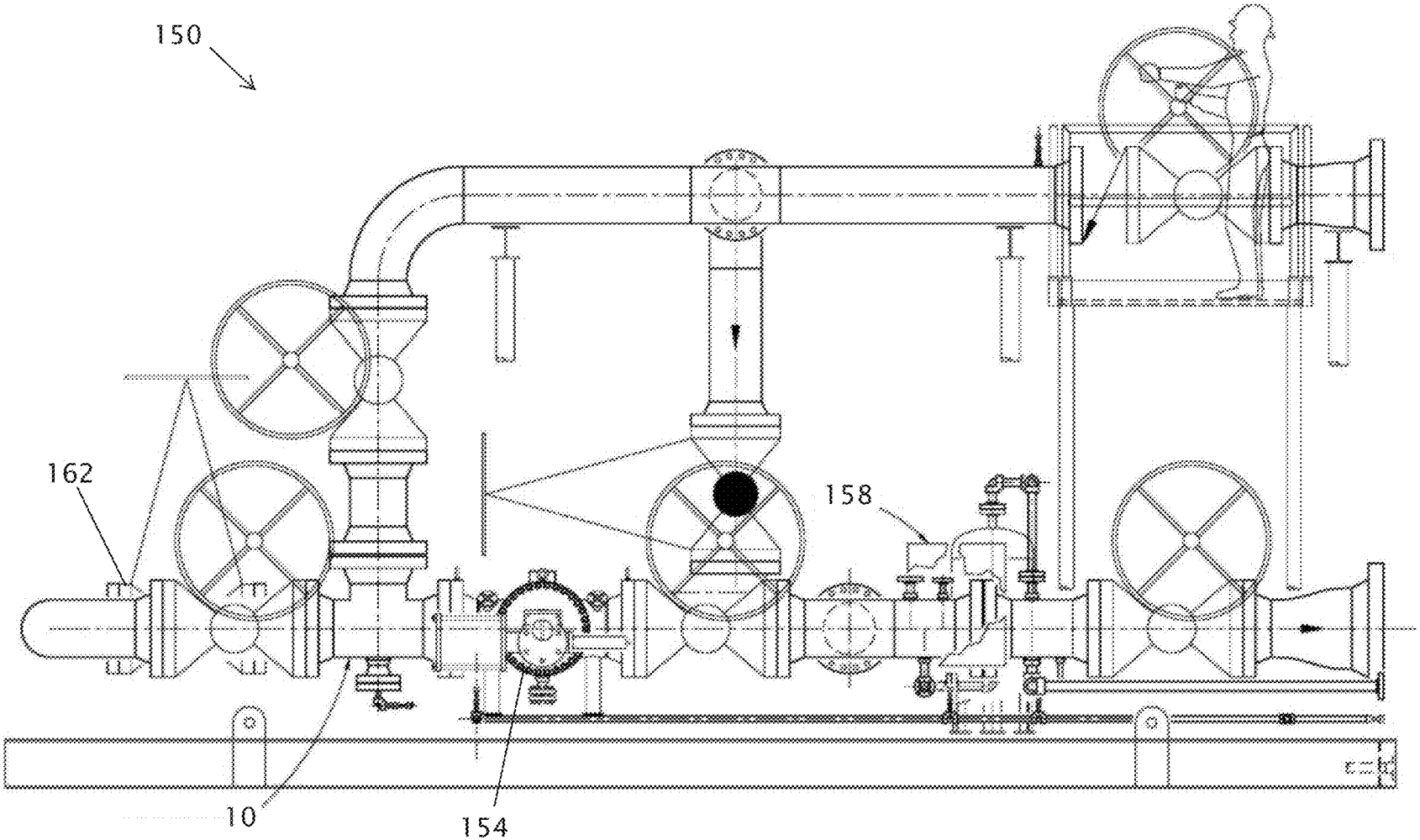
FIG. 5 depicts a crude blending system including the mixer of FIGS. 4A-4D.

FIG. 5 depicts a crude blending system 150 including mixer 10. In this embodiment, system 150 also comprises a second mixer or mixing device 154 coupled to first outlet 22 of mixer 10. While shown directly coupled, mixer 10 and mixer 154 can also be indirectly coupled, such as, for example, via an intervening conduit. In the embodiment shown, mixer 154 is different than mixer 10. Mixer 154 may, for example, include a known static mixer (e.g., a ProMix Mixer, offered by ProSep, Inc. of Houston, Tex.). In other embodiments, mixer 154 can include other types of static mixers or dynamic mixers. In the embodiment shown, system 150 further comprises a measuring station 158 downstream of mixers 10, 154. Measuring station 158 can comprise various sensors and controllers (e.g., processor, programmable logic controller (PLC), and/or the like) can be configured and/or used to measure physical parameters of the (e.g., density and/or viscosity) of the mixture to ensure the quality of the mixture and/or, if necessary, adjust the inlet flows of the crudes to mixer 10 to achieve a mixture with desired properties. In some embodiments, the measuring station is disposed in close proximity to the mixer(s) (e.g., within 20, 15, 10, and/or fewer feet), such as, for example, to reduce response time when adjustments are desired. In some embodiments, the controller(s) of measuring station 158 is configured to actuate an inlet valve 162 (which controls flow to first inlet 18 of mixer 10) such that the flow of light and/or lower-viscosity crude to mixer 10 can be automatically adjusted responsive to the properties of the mixture measured by measuring station 158. In other embodiments, the measuring station can be configured to actuate a valve to control the flow of fluid to second inlet 30 of mixer 10 such that the flow of heavy and/or higher-viscosity crude to mixer 10 can also be adjusted.

Some embodiments of the present methods (e.g., for mixing two fluids having different viscosities) comprise: introducing a second fluid (e.g., a heavy crude oil) into a second flow channel (e.g., 62) defined by a sidewall (e.g., 50) of a dispersion member (e.g., 50) having an upstream imperforate portion (e.g., 54) and a downstream perforated portion (e.g., 58), such that the second fluid is extruded through the perforated portion. In such embodiments, the dispersion member can extend into a first flow channel (e.g., 26) having a first fluid (e.g., a light crude oil) flowing through the primary channel. In some such embodiments, a longitudinal axis of the second flow channel is disposed at a non-parallel angle relative to a longitudinal axis of the first flow channel. Some such embodiments use an embodiment of mixer 10. In some embodiments of the present methods, the first fluid flows through the first flow channel at a first flowrate, the second fluid is introduced into the second flow channel at a second flowrate, and the second flowrate does not differ from the first flowrate by more than fifty percent of the first flowrate (e.g., for a first flowrate of 100 gallons per minute (gpm), the second flowrate would not be less than 50 gpm and not more than 150 gpm). In some embodiments, the second flowrate does not differ from the first flowrate by more than thirty percent of the first flowrate.

The advantages of the mixing principle or approach utilized in the present mixing devices, systems, and methods can include, for example, any one or more of the following benefits and advantages. First, the construction is very simple, rugged and low-cost to make (relative to prior art static mixers). Second, the mixer allows the heavy oil to have very high viscosity (several thousand cP) without requiring a large differential pressure for injecting and mixing the heavy oil into the light oil. Third, a very large surface contact area is produced by extruding the heavy oil into the light oil, which allow mixing to occur by dissolving the heavy oil into the light oil. This happens because the light hydrocarbon components in the light oil will act as a solvent for the heavy oil, and a large part of the mixing action is derived from this dissolving process rather than by mixing action caused by fluid-dynamic phenomena (turbulent eddies, shear flow etc). In contrast, mixing via turbulence/shear requires a significant pressure loss when one or both of the fluids are very viscous (>50-200 cP), such that the pressure drop through the present mixers can be significantly lower than prior art static mixers. Fourth, turbulence or turbulent energy is generated by directing the lighter oil around the outside of the basket or dispersion element between the basket and the interior T-element wall as the lighter oil flows toward the center of the exit port. Fifth, the reduced pressure drop through the present mixing devices allow the present mixing devices to be coupled to one or more additional downstream mixing devices without creating an unacceptably large pressure drop across an overall mixing system. Sixth, the present mixing devices allow two fluids of similar flow rates to be effectively mixed, which contrasts with many known mixer designs in which the flowrate of one of two fluids must be much smaller than the flowrate of the other fluid.

The present mixing devices can also be used in applications other than those for crude-oil blending in which a first fluid is mixed with a second fluid of lower viscosity and/or lower density than the first fluid. The present mixing devices are particularly well suited for such other applications that involve a blending fluids to adjust physical properties (e.g., where one fluid can act as a solvent for the other fluid).

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A mixing device for mixing a first oil fluid with a second oil fluid of a different viscosity and/or density, the mixing device comprising:

a body defining a first inlet, a first outlet, and a first flow channel extending from the first inlet to the first outlet, the first flow channel having a central axis extending through the first inlet and the first outlet, the body further defining a second inlet having a longitudinal axis that is disposed at a non-parallel angle relative to a longitudinal axis of the first flow channel;

a dispersion member configured to be coupled to the body such that a sidewall of the dispersion member extends into the first flow channel to intersect the central axis of the first flow channel with an upstream portion of the sidewall facing the first inlet and a downstream portion of the sidewall facing the first outlet, the dispersion member defining a second flow channel in fluid communication with the second inlet and extending across the first flow channel;

where the downstream portion of the sidewall extending into the first flow channel includes a perforated portion;

where the dispersion member is configured to extend across the first flow channel to a lower end that is contoured to match the contour of an interior surface of the body opposite the second inlet.

2. The mixing device of claim 1, where the dispersion member is configured to extrude a second oil fluid from the second inlet through the perforated portion into the first flow channel to mix with a first oil fluid having a lower viscosity and/or lower density flowing in the first flow channel from the first inlet.

3. The mixing device of claim 1, where the perforated portion includes a plurality of perforations.

4. The mixing device of claim 3, where the plurality of perforations includes more than ten perforations.

5. The mixing device of claim 4, where the plurality of perforations includes more than thirty perforations.

6. The mixing device of claim 3, where the area of the perforated portion does not differ from the cross-sectional area of the first flow channel by more than thirty percent of the cross-sectional area of the first flow channel.

7. The mixing device of claim 3, where the plurality of perforations have an open area that does not differ from the cross-sectional area of the first flow channel by more than thirty percent of the cross-sectional area of the first flow channel.

8. The mixing device of claim 1, where the non-parallel angle is between 70 degrees and 110 degrees.

9. The mixing device of claim 1, where the upstream portion of the sidewall extending into the first flow channel is not perforated.

10. The mixing device of claim 9, where the second flow channel has a cross-sectional shape that is circular.

11. The mixing device of claim 10, where the dispersion member has an outer cross-sectional shape that is circular.

12. The mixing device of claim 1, where the body further comprises a second outlet in fluid communication with the first flow channel.

13. A system comprising:

a first mixing device of claim 1; and a second mixing device coupled to the first outlet of the first mixing device;

where the second mixing device is different than the first mixing device.

14. The apparatus of claim 1, where the lower end of the dispersion chamber extends to an interior surface of the body opposite the second inlet to substantially prevent liquid flowing between the lower end and the interior surface.

15. The apparatus of claim 1, where a lower end of the dispersion member extending into the body is shaped to resist rotation of the dispersion member.

16. The apparatus of claim 1, where the dispersion member comprises a basket-like insert having a tubular configuration defined by the sidewall, and a flange is attached to the sidewall at the an upper end of the dispersion member.

17. A mixing device for mixing a first oil fluid with a second oil fluid of a different viscosity and/or density, the mixing device comprising:

a body defining a first inlet, a first outlet, and a first flow channel extending from the first inlet to the first outlet, the body further defining a second inlet having a longitudinal axis that is disposed at a non-parallel angle relative to a longitudinal axis of the first flow channel;

a dispersion member configured to be coupled to the body such that a sidewall of the dispersion member extends into the first flow channel with an upstream portion of the sidewall facing the first inlet and a downstream portion of the sidewall facing the first outlet, the dispersion member defining a second flow channel in fluid communication with the second inlet;

where the downstream portion of the sidewall extending into the first flow channel includes a perforated portion comprising a plurality of perforations; and where the plurality of perforations each has a maximum transverse dimension and is spaced from at least one other one of the plurality of perforations by a distance that is smaller than the maximum transverse dimension.

18. A mixing device for mixing a first oil fluid with a second oil fluid of a different viscosity and/or density, the mixing device comprising:

a body defining a first inlet, a first outlet, and a first flow channel extending from the first inlet to the first outlet, the body further defining a second inlet having a longitudinal axis that is disposed at a non-parallel angle relative to a longitudinal axis of the first flow channel;

a dispersion member configured to be coupled to the body such that a sidewall of the dispersion member extends into the first flow channel with an upstream portion of the sidewall facing the first inlet and a downstream portion of the sidewall facing the first outlet, the dispersion member defining a second flow channel in fluid communication with the second inlet;

where the downstream portion of the sidewall extending into the first flow channel includes a perforated portion comprising a plurality of perforations; and where the plurality of perforations have an open area that is greater than fifty percent of the area of the perforated portion.

19. A mixing device for mixing a first oil fluid with a second oil fluid of a different viscosity and/or density, the mixing device comprising:

a body defining a first inlet, a first outlet, and a first flow channel from the first inlet to the first outlet, the body further defining a second inlet;

a dispersion member configured to be coupled to the body such that a sidewall of the dispersion member extends into the first flow channel with an upstream portion of the sidewall facing the first inlet and a downstream portion of the sidewall facing the first outlet, the dispersion member defining a second flow channel in fluid communication with the second inlet;

where the downstream portion of the sidewall extending into the first flow channel includes a perforated portion with a plurality of perforations having an open area that does not differ from the cross-sectional area of the first flow channel by more than thirty percent of the cross-sectional area of the first flow channel.

20. A method for mixing two liquids having different viscosities, the method comprising:

introducing a second liquid into a second flow channel defined by a sidewall of a dispersion member having an upstream imperforate portion and a downstream perforated portion, such that the second liquid is extruded through the perforated portion;

where the dispersion member extends into a first flow channel having a first liquid flowing through the first flow channel, a longitudinal axis of the second flow channel is disposed at a non-parallel angle relative to a longitudinal axis of the first flow channel, and the viscosity and/or density of the second liquid is greater than the viscosity and/or density of the first liquid;

where the dispersion member is configured to extend across the first flow channel to a lower end that is contoured to match the contour of an interior surface of a body opposite the second inlet.

21. The method of claim 20, where the first liquid flows through the first flow channel at a first flowrate, the second liquid is introduced into the second flow channel at a second flowrate, and the second flowrate does not differ from the first flowrate by more than fifty percent of the first flowrate.

22. The method of claim 21, where the second flowrate does not differ from the first flowrate by more than thirty percent of the first flowrate.

23. The method of claim 20, where the first and second liquids each comprise crude oil.

* * * * *